US008800608B2

(12) United States Patent
Giribona et al.

(10) Patent No.: US 8,800,608 B2
(45) Date of Patent: Aug. 12, 2014

(54) MACHINE FOR THE PREPARATION OF PHARMACEUTICAL PRODUCTS

(71) Applicant: Health Robotics S.R.L., Bolzano (IT)

(72) Inventors: Paolo Giribona, Trieste (IT); Werner Rainer, Naturno (IT); Daniele Baldassari, Sassoferrato (IT); Alferino Gabbarrini, Cupramontana (IT); Pietro Paluselli, Bolzano (IT)

(73) Assignee: Health Robotics, S.R.L. (IT)

( * ) Notice: Subject to any disclaimer, the term of this patent is extended or adjusted under 35 U.S.C. 154(b) by 0 days.

(21) Appl. No.: 13/661,398

(22) Filed: Oct. 26, 2012

(65) Prior Publication Data

US 2013/0192165 A1 Aug. 1, 2013

Related U.S. Application Data

(62) Division of application No. 12/374,875, filed as application No. PCT/IB2006/003505 on Dec. 7, 2006, now Pat. No. 8,297,320.

(30) Foreign Application Priority Data

| | | |
|---|---|---|
| Jul. 26, 2006 | (IT) | AN2006A0044 |
| Sep. 27, 2006 | (WO) | PCT/IT2006/000688 |
| Oct. 16, 2006 | (WO) | PCT/IT2006/000739 |
| Oct. 16, 2006 | (WO) | PCT/IT2006/000740 |

(51) Int. Cl.
*B65B 31/00* (2006.01)

(52) U.S. Cl.
USPC ..... 141/85; 141/2; 141/27; 141/51; 141/63; 141/248

(58) Field of Classification Search
USPC ..... 141/2, 27, 51, 63, 85–89, 248
See application file for complete search history.

(56) References Cited

U.S. PATENT DOCUMENTS

| | | | | |
|---|---|---|---|---|
| 4,928,853 | A * | 5/1990 | Isham et al. | 222/108 |
| 4,989,649 | A | 2/1991 | Weiler et al. | |
| 6,134,866 | A | 10/2000 | Schoenewolff et al. | |
| 6,267,927 | B1 | 7/2001 | Pomar Longedo et al. | |
| 6,347,650 | B1 * | 2/2002 | Affleck et al. | 141/181 |

(Continued)

FOREIGN PATENT DOCUMENTS

| | | |
|---|---|---|
| DE | 2326244 | 12/1974 |
| EP | 1291658 | 3/2003 |

OTHER PUBLICATIONS

U.S. Appl. No. 13/661,405, filed Oct. 26, 2012, Giribona et al.

(Continued)

*Primary Examiner* — Gregory Huson
*Assistant Examiner* — Nicolas A Arnett
(74) *Attorney, Agent, or Firm* — Sheridan Ross P.C.

(57) ABSTRACT

A machine for the preparation of pharmaceutical products is provided with a gripping and carrier device to transfer at least one container between a magazine and a dosage station for the preparation of a pharmaceutical product, and a box-type holding frame defining a chamber for the housing of magazine, gripping and carrier device, and dosage station; the chamber displaying an access aperture to magazine and being crossed by a sterile air flow adapted to avoid the entry of air from the external environment through aperture itself.

6 Claims, 9 Drawing Sheets

(56) References Cited

U.S. PATENT DOCUMENTS

| | | | | |
|---|---|---|---|---|
| 6,915,823 | B2 * | 7/2005 | Osborne et al. | 141/27 |
| 6,991,002 | B2 * | 1/2006 | Osborne et al. | 141/27 |
| 7,017,622 | B2 * | 3/2006 | Osborne et al. | 141/27 |
| 7,117,902 | B2 * | 10/2006 | Osborne | 141/27 |
| 7,481,371 | B2 | 1/2009 | Heidorn | |
| 7,490,453 | B2 | 2/2009 | Py et al. | |
| 7,707,807 | B2 | 5/2010 | Py | |
| 7,726,353 | B2 | 6/2010 | Okabe | |
| 7,783,383 | B2 * | 8/2010 | Eliuk et al. | 700/245 |
| 7,930,066 | B2 * | 4/2011 | Eliuk et al. | 700/245 |
| 7,975,453 | B2 | 7/2011 | Py | |
| 8,082,955 | B2 | 12/2011 | Okabe | |
| 8,297,320 | B2 | 10/2012 | Giribona et al. | |
| 2005/0279419 | A1 * | 12/2005 | Tribble et al. | 141/27 |
| 2006/0151714 | A1 | 7/2006 | Thilly et al. | |
| 2009/0169342 | A1 | 7/2009 | Yoshimura et al. | |
| 2011/0067781 | A1 * | 3/2011 | Osborne | 141/37 |
| 2011/0158865 | A1 * | 6/2011 | Miller et al. | 422/544 |
| 2012/0222774 | A1 * | 9/2012 | Husnu et al. | 141/69 |

OTHER PUBLICATIONS

International Search Report prepared by the European Patent Office on Jan. 10, 2008, for International Application No. PCT/IB2006/003505.

Little et al. "Recent Advances in Robotic Automation of Microplate Assays"; Laboratory Automation & Information Management; Elsevier Science Publishers BV., Amsterdam, NL; vol. 26, No. 2, Nov. 1, 1994; pp. 89-99.

Official Action for U.S. Appl. No. 12/374,875, mailed Sep. 14, 2011 6 pages Restriction Requirement.

Official Action for U.S. Appl. No. 12/374,875, mailed Mar. 23, 2012 8 pages.

Notice of Allowance for U.S. Appl. No. 12/374,875, mailed Jun. 26, 2012 10 pages.

* cited by examiner

MACHINE FOR THE PREPARATION OF PHARMACEUTICAL PRODUCTS

CROSS REFERENCE TO RELATED APPLICATIONS

This application is a divisional of U.S. patent application Ser. No. 12/374,875 filed Jun. 2, 2009. This application is also a national stage application under 35 U.S.C. 371 of PCT Application No. PCT/IB2006/003505 having an international filing date of 7 Dec. 2006, which designated the United States, which PCT application claimed the benefit of Italian Application No. AN2006A 000044 filed Jul. 26, 2006; International Application Nos. PCT/IT2006/000688 filed Sep. 27, 2006; PCT/IT2006/000739 filed Oct. 16, 2006; and PCT/IT2006/000740 filed Oct. 17, 2006, the entire disclosure of each of which are hereby incorporated herein by reference.

TECHNICAL FIELD

The present invention relates to a machine for the preparation of pharmaceutical products.

Specifically, the present invention relates to a machine for the preparation of toxic pharmaceutical products as, for example, cytostatic drugs for chemotherapy, to which the following description will explicitly refer without thereby departing from generality.

BACKGROUND ART

In the field of the preparation of cytostatic drugs, a machine is known comprising a magazine for a plurality of containers; a dosage station for the preparation of a pharmaceutical product obtained by mixing at least one cytostatic pharmaceutical compound and at least one diluent contained in corresponding containers; and a gripping and carrier device to transfer the containers between the magazine and the dosage station.

The apparatus generally comprises a box-type holding frame defining a first chamber, which houses the magazine therein, and is provided with an aperture to allow the operator to load and/or unload the magazine, and a second chamber, which houses the dosage station and the gripping and carrier device therein, is maintained in substantially sterile conditions, and is in communication with the first chamber in order to allow the gripping and carrier device to transfer the containers between the magazine and the dosage station.

The known machines of the above described type have some drawbacks mainly deriving from the fact that, when the first chamber is opened to allow the loading and/or unloading operations of the magazine, the first chamber is in communication with the external environment totally exposing the operator to risks correlated to the presence of the cytostatic drugs used in such machines and thus impairing the sterility of prepared pharmaceutical products.

DISCLOSURE OF INVENTION

It is an object of the present invention to provide a machine for the preparation of pharmaceutical products which is free from the above described drawbacks and is simple and cost-effective to be implemented.

According to the present invention there is provided a machine for the preparation of pharmaceutical products according to the accompanying claims.

BRIEF DESCRIPTION OF THE DRAWINGS

The present invention will now be described with reference to the accompanying drawings, which show an example of non-limitative embodiment thereof, in which.

BEST MODE FOR CARRYING OUT THE INVENTION

Figure 1:
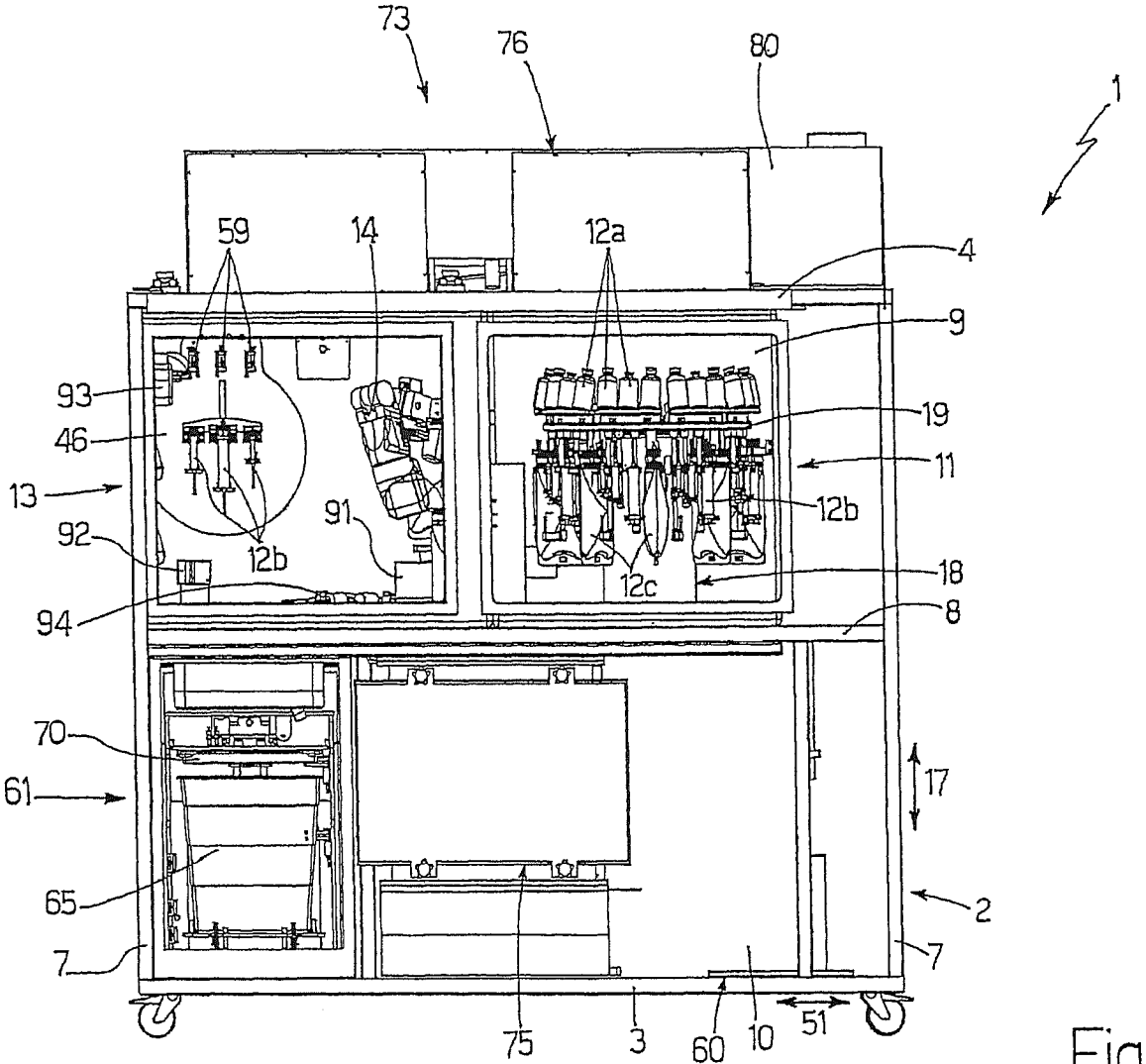
FIG. 1 is a diagrammatic front view, with parts removed for clarity, of a preferred embodiment of the machine of the present invention.
Figure 3:
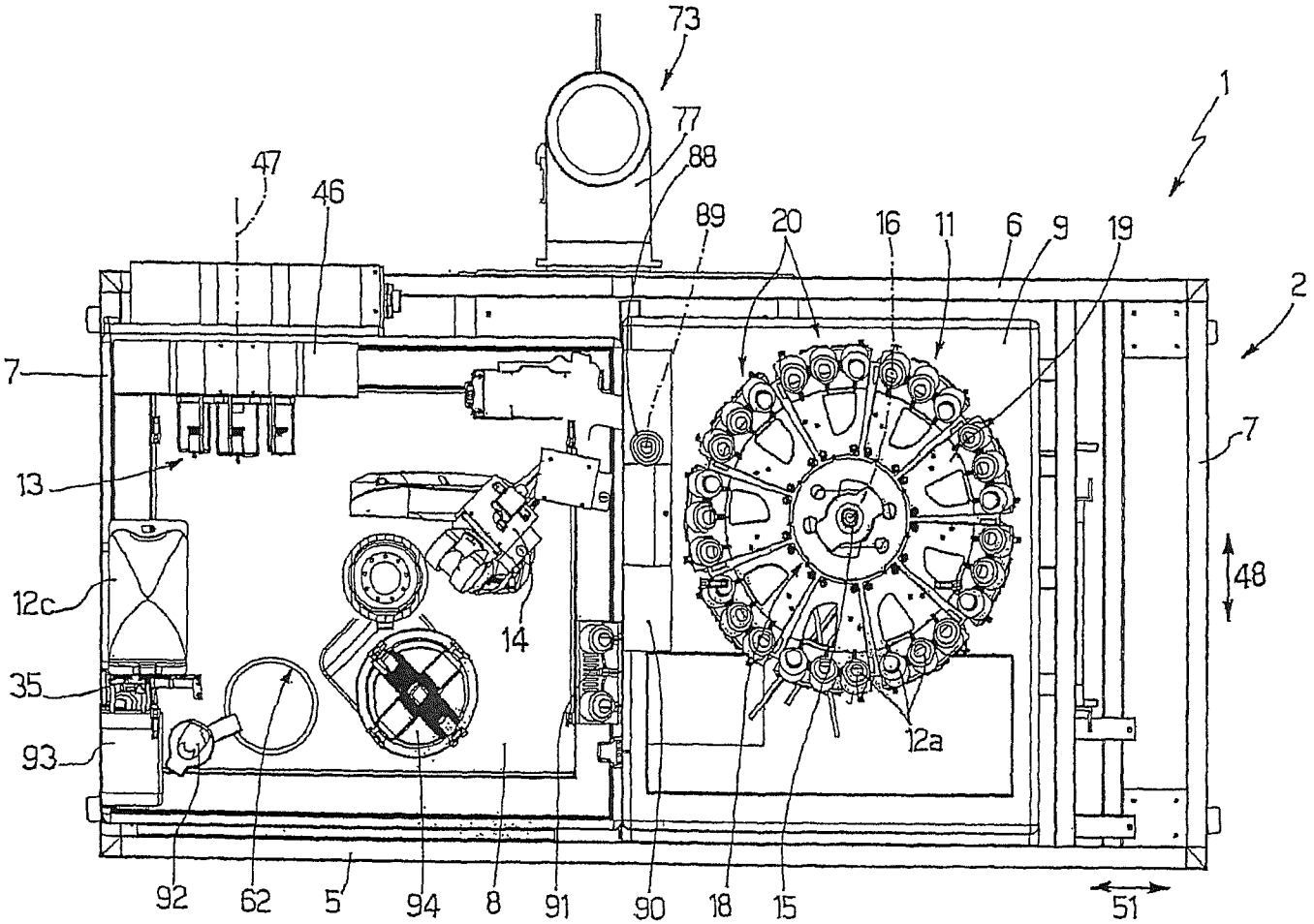
FIG. 3 is a diagrammatic plan view, with parts removed for clarity, of the machine in FIGS. 1 and 2.

With reference to FIGS. 1 and 3, number 1 indicates, as a whole, a machine for the preparation of pharmaceutical products, in this case toxic pharmaceutical products as, for example, cytostatic drugs for chemotherapy.

Machine 1 comprises a box-type holding frame 2 having substantially parallelepipedal shape, which is delimited by a lower wall 3 and an upper wall 4, which are substantially horizontal and parallel to one another, by a front wall 5 and a back wall 6, which are substantially vertical and parallel to one another, and by two side walls 7, which are substantially parallel to one another and orthogonal to walls 3, 4, 5 and 6.

Frame 2 is internally subdivided by an intermediate wall 8, which is substantially parallel to walls 3 and 4, in an upper chamber 9 and a lower chamber 10.

Upper chamber 9 houses therein a magazine 11 for a plurality of containers 12, which will be further shown hereinafter, a dosage station 13 for the preparation of the pharmaceutical products, and a gripping and carrier device 14 to displace containers 12 within chamber 9 itself.

Magazine 11 comprises a shaft 15 (FIG. 3), which is rotatably mounted on frame 2 to selectively rotate in intermittent manner with respect to frame 2 and under the drive of a known motor (not shown) about a longitudinal axis 16 thereof parallel to a substantially vertical direction 17, is housed inside a holding cylinder 18 coaxial to axis 16, and carries a disk 19—splined to an upper free end thereof—which is orthogonally mounted to axis 16, and supports a plurality of gripping and carrier units 20 (in this case nine units 20) uniformly distributed around axis 16 itself.

Figure 4:
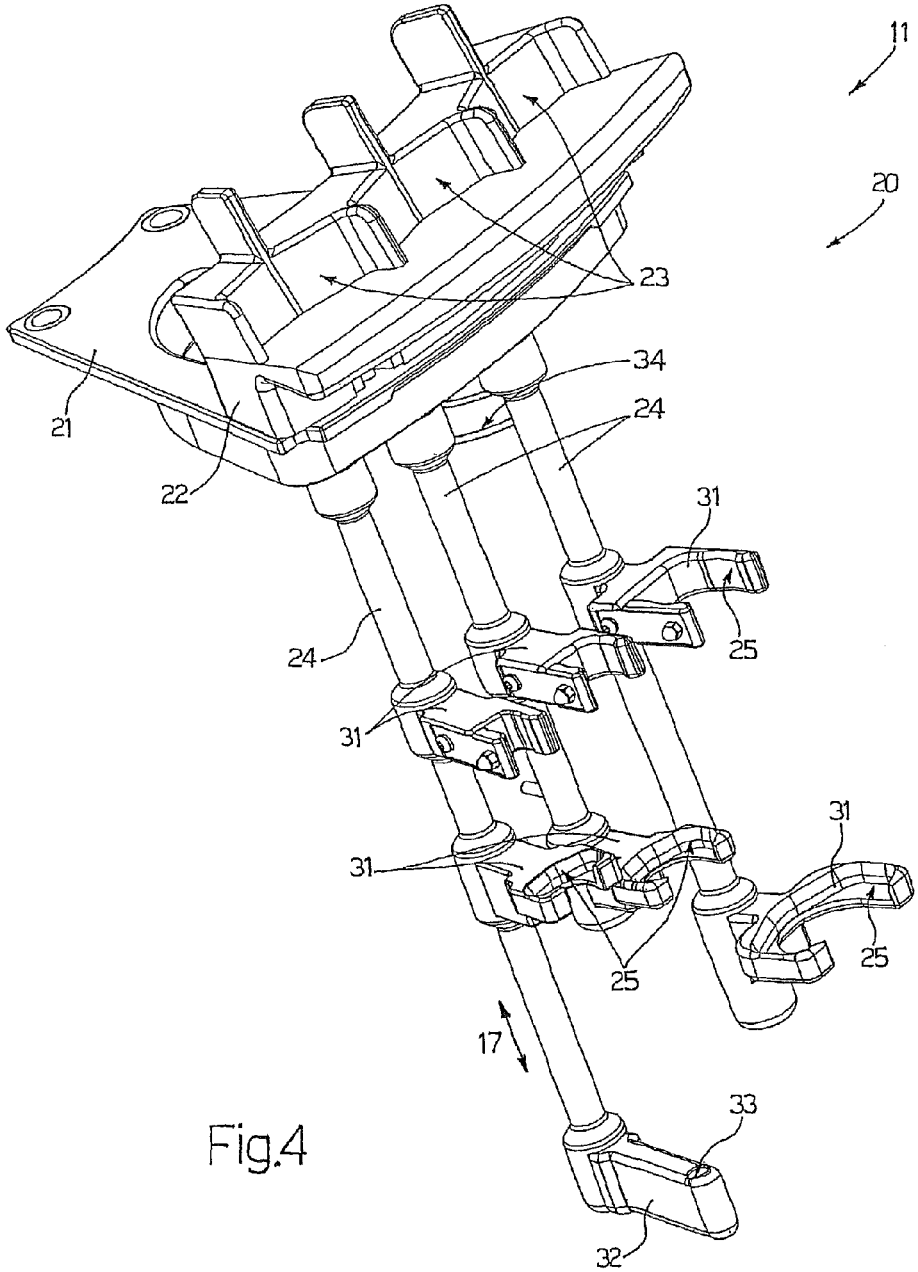
FIG. 4 is a perspective view of a first detail of the machine in FIGS. 1, 2 and 3.

With reference to FIG. 4, each unit 20 comprises a hooking plate 21, which is fixed over disk 19, and is provided with a resting block 22 that extends upwards from plate 21, and is provided in this case with three seats 23 for respective glass bottles of the known type (hereafter indicated with 12*a*).

Plate 21 also displays three elongated rods 24, which extend downwards from plate 21 through disk 19, are substantially parallel to direction 17, and are provided with respective seats 25 for respective known syringes (hereafter indicated with 12*b*) of different diameter and length, each of which comprises a holding cylinder 26, which is closed at one end by a needle 27 provided with a protection cap 28, and is slidingly engaged by a piston 29 provided with a head 30 which is substantially flat and orthogonal to piston 29 itself.

Each seat 25 comprises two gripping elements 31, which substantially have the shape of a fork, are axially spaced along corresponding rod 24, and reciprocally cooperate to receive and hold the corresponding syringe 12*b*, which is inserted in elements 26 in a transverse direction to axis 16 and with needle 27 facing upwards.

At least one of the rods 24 is also provided with a support element 32 displaying a bore 33, which is obtained through element 32 parallelly to direction 17, and is adapted to house therein a needle of the known type (not shown), the use of which will be further described hereinafter.

Plate 21 is further provided with a bracket (not shown), which extends downwards from plate 21 through disk 19, is substantially parallel to direction 17, and supports at a lower free end thereof a pocket 34, which is radially open towards the outside in order to be slidingly engaged by an adapter member 35 mounted on a plastic material bag of the known type (hereinafter indicated with 12*c*) provided with two necks 36 for the transfer of fluids from and to bag 12*c* itself.

Figure 5:
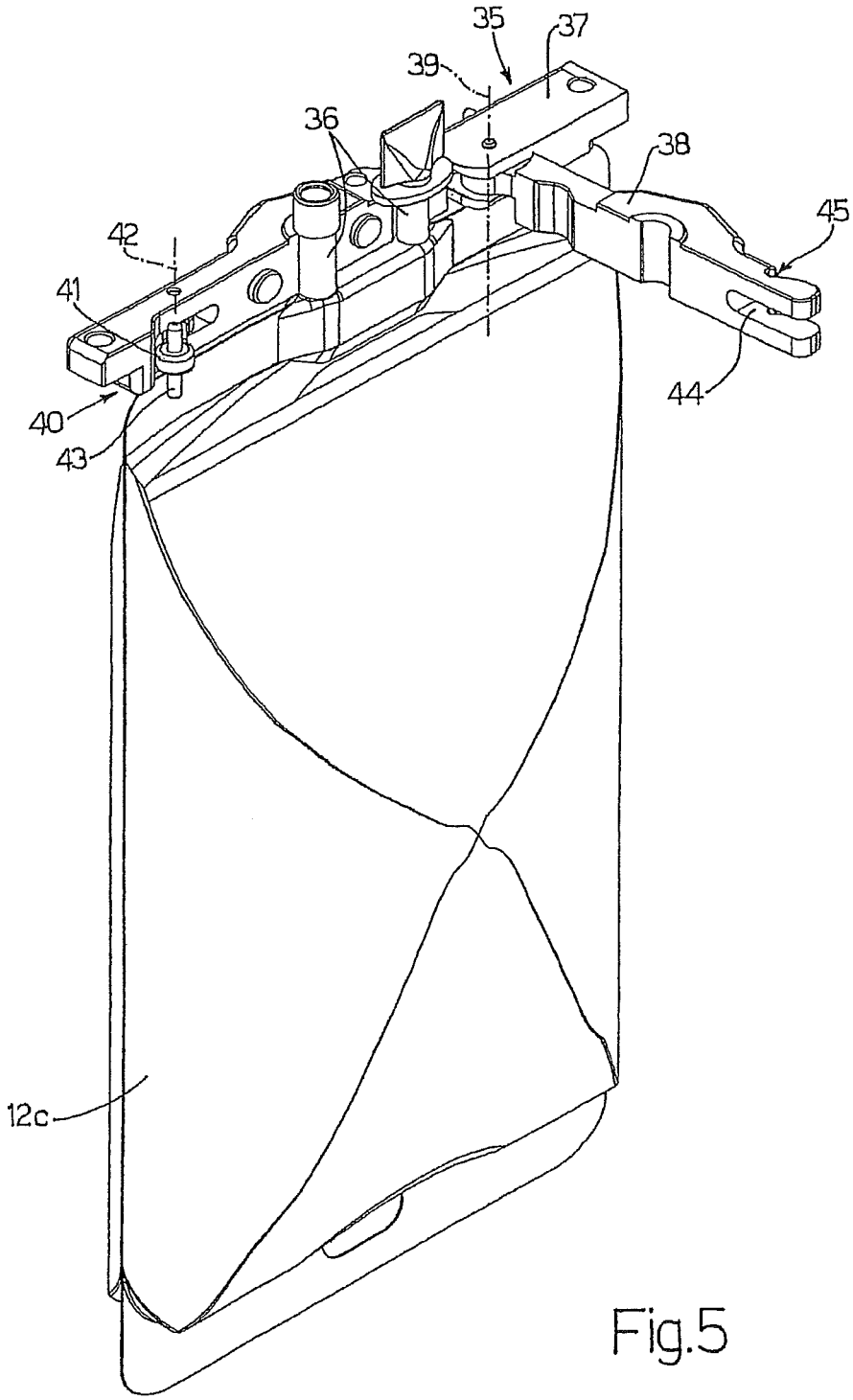
FIG. 5 is a perspective view of a second detail of the machine in FIGS. 1, 2 and 3.

According to FIG. 5, member 35 comprises two substantially flat profiled jaws 37, 38, which have a thickness substantially thinner than the length of a neck 36, and are reciprocally hinged to rotate one with respect to the other about an axis 39 substantially perpendicular to jaws 37, 38 between a clamping position (not shown) and a release position (FIG. 5) of the two necks 36 themselves.

Jaws 37, 38 are locked in the clamping position by means of a locking device 40 comprising a crank 41 hinged to jaw 37 in order to swing with respect to jaw 37 itself about an axis 42 parallel to axis 39, and a pin 43, which is mounted through crank 41 parallelly to axes 39 and 42 and is displaced by crank 41 between a release position (FIG. 5) and a locking position (not shown), in which crank 41 is displaced through a slit 44 obtained through jaw 38 to engage pin 43 in a seat 45 obtained on jaw 38.

Figure 6:
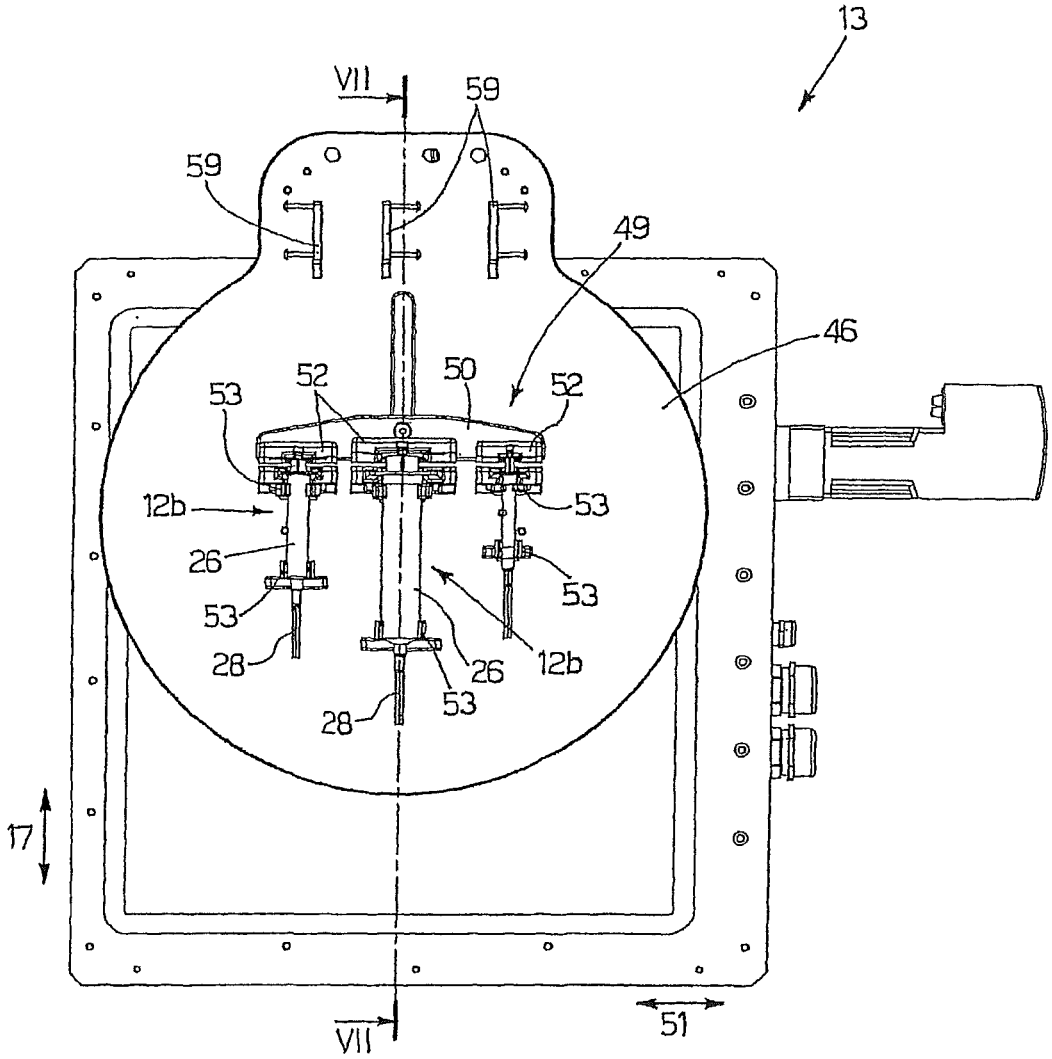
FIG. 6 is a front view of a third detail of the machine in FIGS. 1, 2 and 3.

With reference to FIGS. 1, 3 and 6, dosage station 13 comprises a substantially flat turntable 46, which is rotatably coupled to frame 2 in order to rotate with respect to frame 2 and under the drive of a known motor (not shown) about a rotation axis 47 parallel to a direction 48 which is horizontal and transverse to direction 17, and supports a gripping device 49 adapted to receive and hold three syringes 12*b* having different diameters and lengths.

Figure 7:
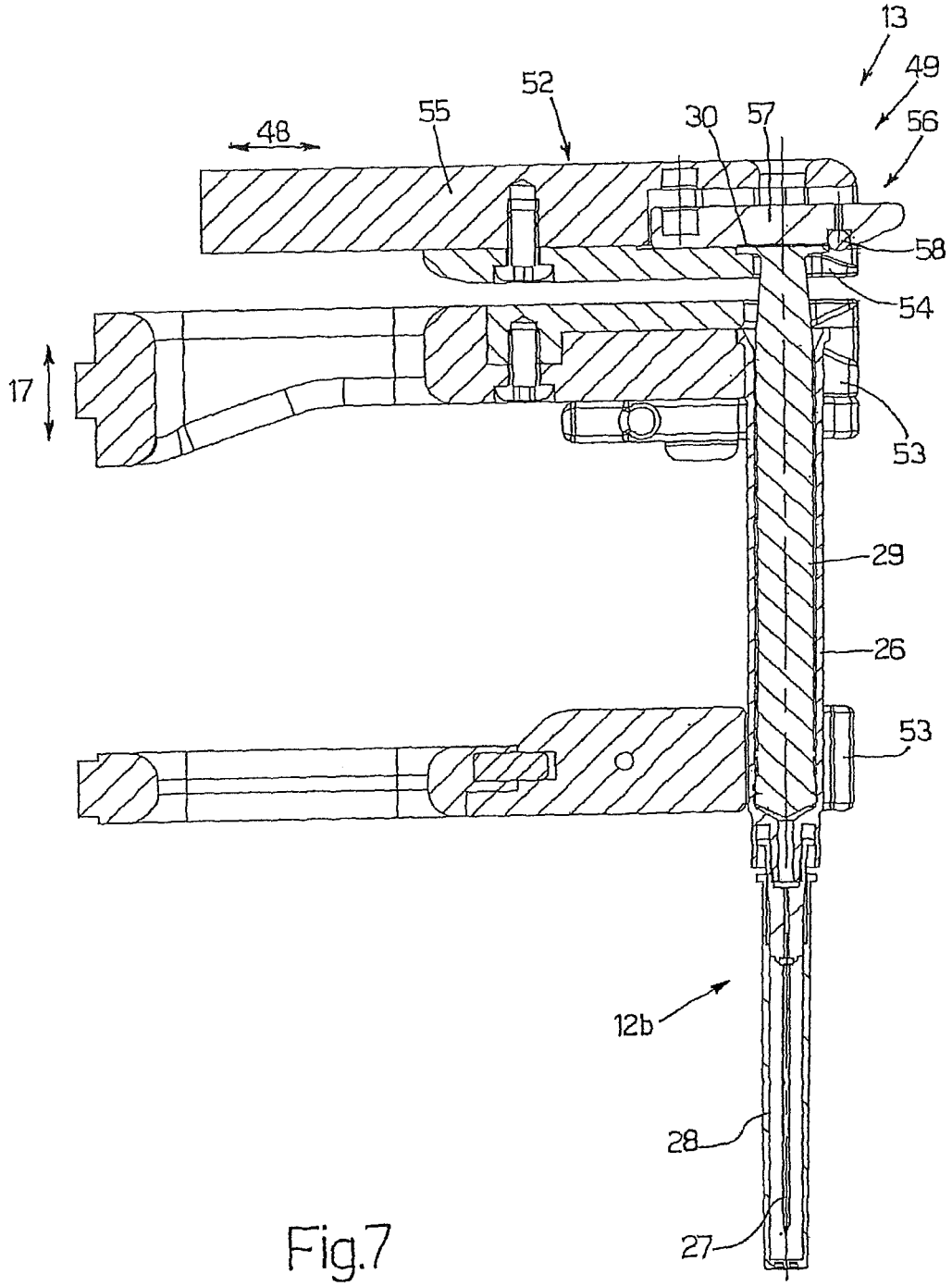
FIG. 7 is a section along line VII-VII of FIG. 6.

According to FIGS. 6 and 7, device 49 comprises a slide 50, which extends in a direction 51 which is horizontal and orthogonal to directions 17 and 48, is coupled in a known manner to turntable 46 in order to carry out rectilinear displacements in direction 17 with respect to turntable 46 and under the drive of a known motor (not shown), and in this case is provided with three gripping elements 52 distributed along slide 50 in direction 51.

Each element 52 protrudes from slide 50 in direction 48 and cooperates with two gripping elements 53, which protrude from turntable 46 in direction 48, are aligned with element 52 in direction 17, and have substantially the shape of a fork adapted to receive and hold cylinder 26 of a corresponding syringe 12*b*. Element 52 comprises two jaws 54, 55, which are flat and orthogonal to direction 17, and among which jaw 54 is arranged between jaw 55 and gripping elements 53 and has substantially the shape of a fork adapted to receive the piston 29 of corresponding syringe 12*b*.

While in use, syringe 12*b* is mounted on turntable 46 with needle 27 facing downwards and, therefore, during the insertion of syringe 12*b* in gripping device 49, turntable 46 is arranged with elements 53 under element 52 (FIGS. 6 and 7).

The correct insertion of piston 29 inside jaw 54 is assured by a detecting device 56 comprising a substantially flat shoe 57, which is mounted between jaws 54, 55, and is slidingly coupled to jaw 55 in order to carry out rectilinear displacements in direction 17 with respect to jaw 55 and by modes which will be further illustrated hereinafter.

During insertion of piston 29 inside jaw 54 in direction 48, head 30 of piston 29 engages a sphere 58 protruding from shoe 57 in direction 17 so as to raise shoe 57 in direction 17 itself. When the insertion of piston 29 and head 30 in jaw 54 is correctly completed, shoe 57 is lowered again by gravity in its starting position, whereas, when the insertion of piston 29 and head 30 in jaw 54 is not correctly completed, shoe 57 remains raised under the thrust of head 30 itself.

The position of shoe 57 in direction 17 is detected by a photoelectric cell 59, which is mounted on turntable 46, is aligned with syringe 12*b* in direction 17, and is also adapted to detect while in use the position of piston 29 in direction 17 itself.

According to a variant not shown, jaws 54, 55 are eliminated and replaced by two jaws slidingly coupled to slide 50 so that they are displaced one with respect to the other in direction 17 between a release position and a clamping position of head 30 of syringe 12*b*.

With reference to FIGS. 1 and 3, gripping and carrier device 14 is defined by a known-type robot comprising a plurality of reciprocally hinged articulated arms and a gripping clamp mounted on the free end of the articulated arms and configured so as to grab bottles 12*a*, syringes 12*b*, and adapter members 35 of bags 12*c*.

Lower chamber 10 houses therein an electronic control unit 60 for the operation of machine 1, and a collection device 61 for the processing waste of machine 1. Device 61 is arranged at dosage station 13, and communicates with upper chamber 9 through aperture 62 (FIG. 3), which is obtained through intermediate wall 8 parallelly to direction 17, and is provided with a horizontal shutter (not shown), which is mobile between an opening position and a closure position of aperture 62 itself.

Figure 8:
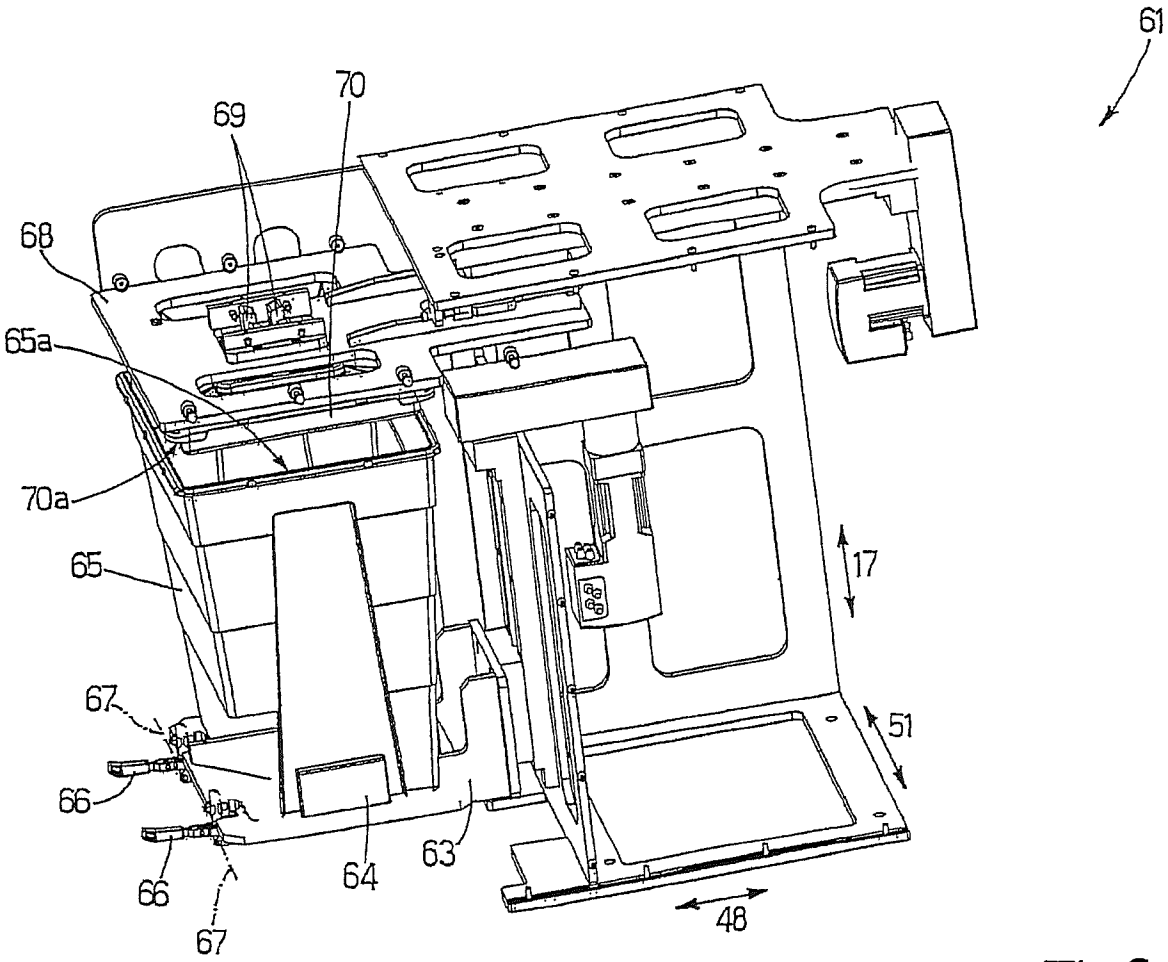
FIG. 8 is a perspective view of a fourth detail of the machine in FIGS. 1, 2 and 3.

According to FIG. 8, device 61 comprises a vertical slide 63, which is coupled in a known manner to frame 2 in order to carry out rectilinear displacements in direction 17 with respect to frame 2 and under the drive of a known-type motor, and is limited in direction 51 by two side panels 64 defining a seat for a vessel 65. Vessel 65 is arranged between panels 64 and under aperture 62 with its concavity facing upwards, and is locked on the slide 63 in direction 48 by means of stop members 66 hinged to slide 63 in order to swing with respect to slide 63 itself, about respective fulcrum axes 67, which are parallel to direction 51.

Device 61 also comprises a horizontal slide 68, which is coupled in a known manner to frame 2 in order to carry out rectilinear displacements in direction 48 with respect to frame 2 and under the drive of a known-type motor, and is provided with a pair of equalizers 69, which are hinged to slide 68 and are mobile from and to a hooking position of a closing lid 70 of vessel 65.

Lid 70 protrudes downwards from slide 68, has a peripheral edge 70*a* provided with an adhesive compound, and is normally arranged by the side of vessel 65 to allow vessel 65 itself to be arranged in a raised working position (not shown).

Device 61 also comprises a known sensor (not shown) to control the filling level of the vessel 65.

While in use, once the vessel 65 has been filled and lowered, lid 70 is displaced in direction 48 over vessel 65, and vessel 65 is raised again in order to allow edge 70*a* to engage a corresponding peripheral edge 65*a* of vessel 65 and to allow lid 70 to hermetically seal the vessel 65 itself.

Figure 2:
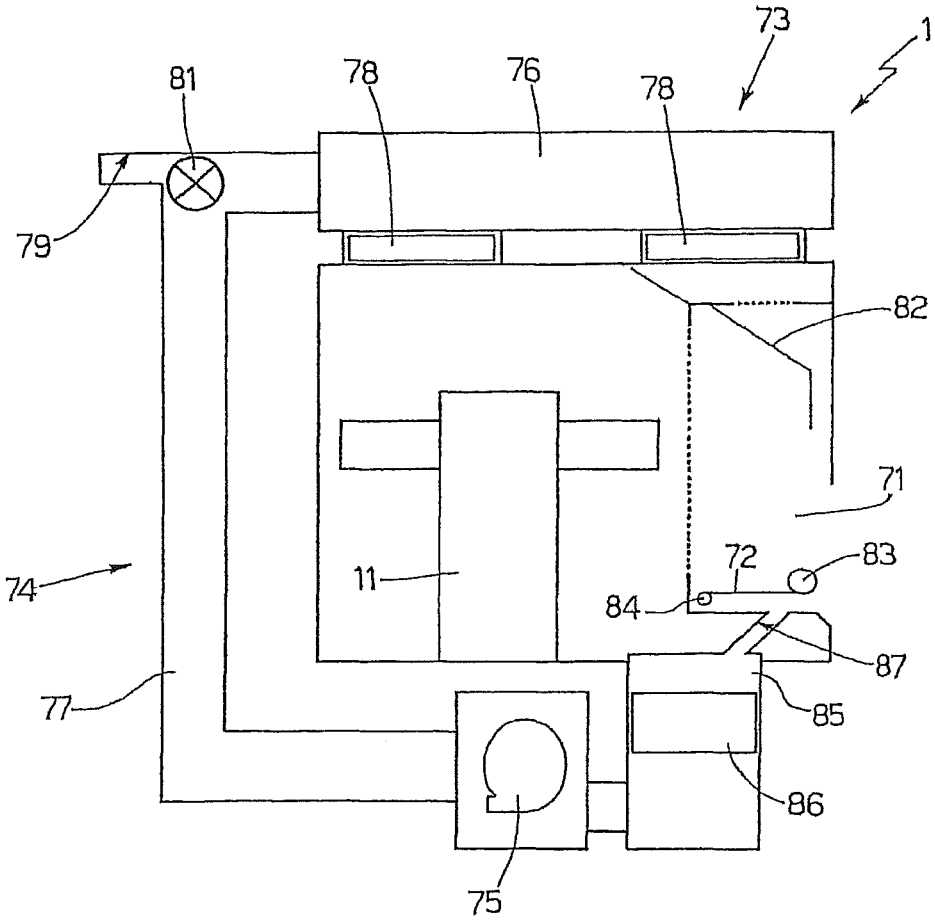
FIG. 2 is a diagrammatic side view, with parts removed for clarity, of the machine in FIG. 1.

With reference to FIGS. 1 and 2, upper chamber 9 is in communication with the external environment through aperture 71, which is obtained through frame 2 in direction 48 in order to allow the operators to gain access to magazine 11, is associated to a vertical shutter (not shown), which is mobile in direction 51 between an opening position and a closure position of aperture 71 itself, and is limited below by a table 72 defining a substantially horizontal resting base for bottles 12*a*, syringes 12*b*, bags 12*c*, and the needles (not shown) which need to be loaded on, or unloaded from, magazine 11.

Upper chamber 9 is maintained in substantially sterile conditions through a pneumatic device 73, which is configured so as to supply a sterile air flow through chamber 9 in order to prevent the entry of air from the external environment into chamber 9 through aperture 71, and to prevent the exit of the sterile air flow from chamber 9 through aperture 71 itself, and comprises a ring pneumatic circuit 74 and a fan wheel 75 housed in lower chamber 10 to assure the air circulation along circuit 74 itself.

Circuit 74 comprises a chamber 76, which is mounted on upper wall 4 of frame 2, is connected to fan wheel 75 by means of a conduit 77, and is in communication with upper chamber 9 by means of the interposition of two pairs (only one of which is shown in FIG. 2) of sterilising filters 78 of the known type, mounted on chamber 76 at magazine 11 and, respectively, at dosage station 13; an outlet 79, that is in communication with the external environment, and is also connected to chamber 76 by means of the interposition of a sterilising filter 80 of the known type; and a valve 81 of the known type to selectively control the air flow rate supplied to the outlet 79.

The sterile air flow supplied inside upper chamber 9 is partly diverted towards aperture 71 by means of a first diverting element 82, which is profiled so as to create a sterile air barrier at aperture 71 itself, which descends from above towards table 72 to prevent the entry of air into upper chamber 9 from the external environment.

Circuit 74 also comprises a second diverting element 83 having a substantially cylindrical shape, which is mounted on, and connects to, table 72, and is adapted to divert towards upper chamber 9 the sterile air flow descending so as to carry out the cleaning of table 72 and prevent the exit of air from chamber 9 itself.

Circuit 74 is also provided with a third diverting element 84 having substantially cylindrical shape, which is mounted under table 72 on the opposite band with respect to element 83 in direction 48, is connected to table 72, has in this case a radium of curvature smaller than the radium of curvature of element 83, and is adapted to divert the sterile air flow inside an inclined conduit 85 which extends under table 72, is in communication with fan wheel 75 by means of the interposition of a sterilising filter 86, and shows an inlet 87 communicating with the external environment in order to intake from the external environment an air flow rate substantially equal to the air flow rate discharged in the external environment itself through outlet 79.

A first operation mode will now be described with reference to the accompanying drawings, assuming the production of a single pharmaceutical product, and starting from a time at which:

seats 23 are loaded partly with bottles 12*a* containing a diluent as, for example, a physiological or glucosated solution, partly with bottles 12*a* containing a liquid cytostatic compound, and partly with bottles 12*a* containing a cytostatic powder compound;

seats 25 are loaded with respective empty syringes 12*b;* pockets 34 are loaded with respective bags 12*c* provided with corresponding adapter members 35 containing a diluent as, for example, a physiological or glucosated solution;

support elements 32 are loaded with respective needles (not shown); and vessel 65 of collection device 61 is raised near aperture 62.

The presence of syringes 12*b* and bags 12*c* in corresponding seats 25 and, respectively, in corresponding pockets 34 is controlled by means of corresponding known photoelectric cells (not shown) mounted on shaft 15 and facing towards corresponding slits (not shown) radially obtained through holding cylinder 18; and the presence of bottles 12*a* in the corresponding seats 23 is controlled by means of corresponding photoelectric cells mounted over disk 19.

The identification of syringes 12*b* and bags 12*c* loaded in the corresponding seats 25 and, respectively, in the corresponding pockets 34 is carried out by displacing the magazine around axis 16 and in front of a bar code reader (not shown) fixed to frame 2.

Gripping and carrier device 14 firstly withdraws a syringe 12*b* from corresponding seat 25, then inserts the syringe 12*b* in gripping device 49 with needle 27 facing downwards (FIGS. 1, 6 and 7), and finally removes the cap 28 from the needle 27 itself; and the turntable 46 is rotated by 180° in order to position syringe 12*b* with needle 27 facing upwards.

Device 14 therefore withdraws a bottle 12*a* containing a liquid cytostatic compound from the corresponding seat 23 and arranges it on a turntable 88 (FIG. 3), which is rotatably mounted on frame 2 in order to rotate with respect to frame 2 and under the drive of a known motor (not shown) about a rotation axis 89 parallel to direction 17, and forms part of an identification device 90 of the known type further comprising a light source (not shown) and a camera (not shown) adapted to carry out the scanning of a label applied on the bottle 12*a* itself.

Obviously, the identification of bottles 12*a*, syringes 12*b*, and bags 12*c* may be carried out by means of bar codes, labels, RFID tags, or other identifying elements applied on containers 12.

Once identified by device 90, bottle 12*a* taken in consideration is firstly weighted on a scale 91 of the known type, is then transferred at a seal-remover device 92 (FIGS. 1 and 3) of the known type adapted to remove the metal seal (not shown) normally applied on the elastic membrane (not shown) of bottles 12*a* and to unload the metal seal itself (not shown) in vessel 65 through aperture 62, and is finally reversed onto syringe 12*b* in engagement with needle 27.

At this point, slide 50 is lowered in direction 17 in order to allow jaw 54 to lower piston 29 along cylinder 26 under the control of the corresponding photoelectric cell 59 and to allow syringe 12*b* to withdraw from bottle 12*a* a determined amount of liquid cytostatic compound; bottle 12*a* is disengaged from needle 27, and unloaded in vessel 65 or transferred on a resting shelf (not shown) or transferred again to magazine 11; and turntable 46 is rotated by 180° to position syringe 12*b* with needle 27 facing downwards again.

Thereafter, device 14 withdraws a new bottle 12*a* containing a diluent from magazine 11, and the bottle 12*a* is identified by device 90, is weighted on scale 91, is transferred to seal-remover device 92 for the removal of the corresponding metal or plastic seal, and is finally displaced under syringe 12*b* in engagement with needle 27.

Finally, slide 50 is lowered in direction 17 in order for jaw 55 to engage head 30 by means of slide 57 so as to lower piston 29 along cylinder 26 under the control of the corresponding photoelectric cell 59 and to inject the liquid cytostatic compound contained in syringe 12*b* in the new bottle 12*a*; bottle 12*a* with the freshly prepared pharmaceutical product is disengaged from needle 27, weighted on scale 91, and transferred to magazine 11 so it may be withdrawn by the operator; and syringe 12*b* is unloaded in vessel 65.

A second operation mode differs from that set forth above only in that both the liquid cytostatic compound and the diluent are withdrawn by syringe 12*b* and syringe 12*b* containing the freshly prepared pharmaceutical product is transferred to magazine 11 so it may be withdrawn by the operator. Obviously, the diluent may be withdrawn both from a bottle 12*a* and from a bag 12*c*.

A third operation mode differs from that set forth above only in that the pharmaceutical product is prepared in a bag 12*c*.

In this case, bag 12*c* taken in consideration is firstly withdrawn from magazine 11 by means of device 14, is then weighted on scale 91, and is finally transferred to a pumping device 93 (FIG. 3), which has been equipped with the needle (not shown) of one of support elements 32 to withdraw from bag 12*c* an amount of diluent substantially equal to the amount of cytostatic compound to be injected in the bag 12*c* itself.

In order to allow pumping device 93 to correctly withdraw the diluent, bag 12*c* is rested in downwardly inclined position over a pair of pins (not shown) protruding from frame 2 in direction 51, jaws 37, 38 of adapter member 35 are engaged in a pair of pins (not shown) protruding from pumping device 93 in direction 48, and the needle (not shown) of pumping device 93 itself is engaged in one of necks 36 of bag 12*c*.

Once the withdrawal of diluent is completed, bag 12*c* is firstly transferred from device 14 to dosage station 13 in order to receive the cytostatic compound from syringe 12*b* and then to magazine 11 so it may be withdrawn by the operator.

A fourth operation mode differs from that previously set forth only in that the pharmaceutical product is manufactured using a powder or lyophilised cytostatic compound.

In this case, syringe 12*b* firstly withdraws a determined amount of diluent from a corresponding bottle 12*a* or from a corresponding bag 12*c*, and then injects the diluent in bottle 12*a* containing the powder or lyophilised cytostatic compound.

At this point, bottle 12*a* containing the diluent and the powder or lyophilised cytostatic compound is transferred from device 14 to a mixer device 94 in order to mix the diluent and the cytostatic compound together.

Figure 9:
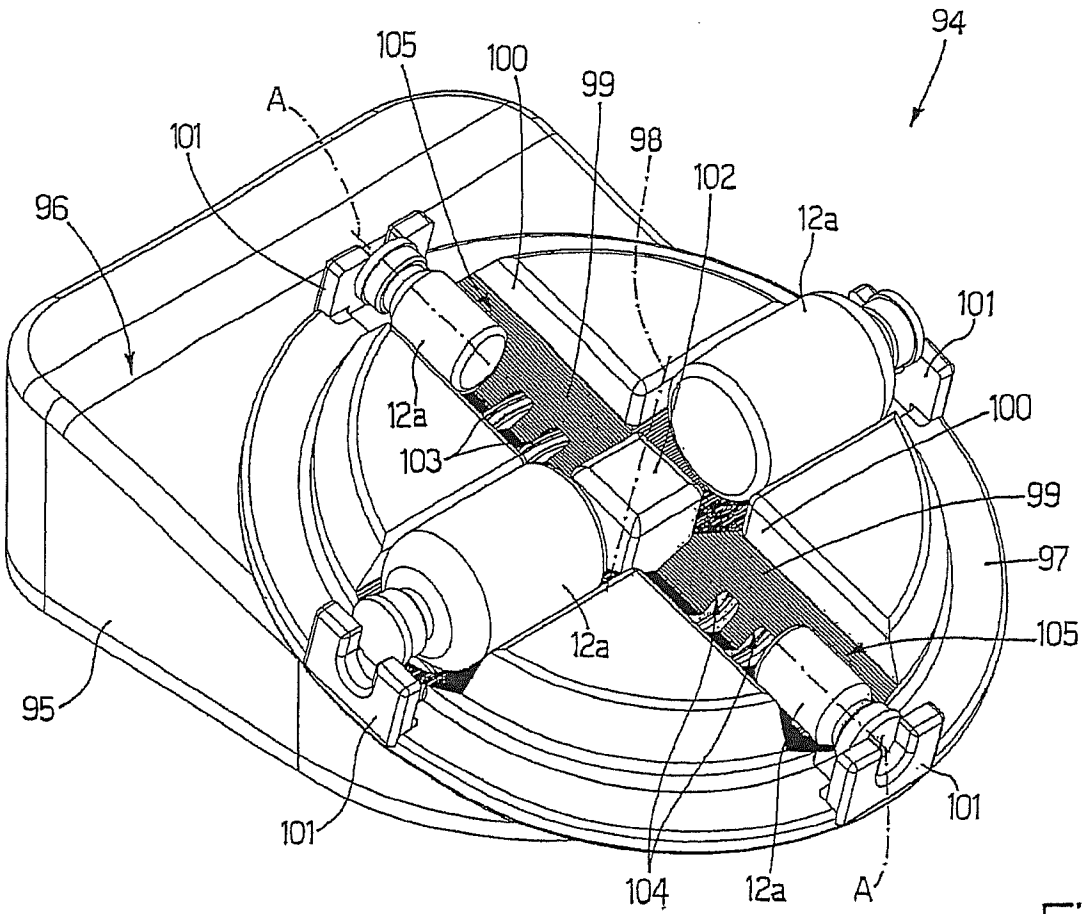
FIG. 9 is a perspective view of a fifth detail of the machine in FIGS. 1, 2 and 3.

With reference to FIG. 9, device 94 comprises a support plate 95, which is fixed to the intermediate wall 8 of frame 2, is limited above by a surface 96 inclined with respect to direction 17, and supports a rotating plate 97 coupled in a known manner to support plate 95 in order to rotate clockwise and/or anti-clockwise with respect to support plate 95 and under the drive of a known motor (not shown) about an axis 98 arranged by an angle other than 90° with respect to wall 8.

Plate 97 comprises a plurality of seats 99 (in this case four seats 99), which are adapted to house therein corresponding bottles 12*a* (even having different size from one another), are distributed uniformly around axis 98, and extend transversely to axis 98 itself.

Each seat 99 is circumferentially limited by two side walls 100 substantially parallel to one another and transverse to axis 98, and is also radially limited by an external end-stop element 101 mounted on the peripheral edge of plate 97 parallelly to axis 98 and by an internal end-stop element 102, which is common to all of seats 99, and is mounted at the centre of plate 97 coaxially to axis 98.

A plurality of annular rubber elements 103 is mounted on upper surface 96 of support plate 95 (in this case four elements 103), which are coaxial to one another and to axis 98, extend around axis 98 according to an angle sharper than 360° so as to define a free portion of surface 96, and engage corresponding slits 104 obtained through a bottom wall 105 of each seat 99 parallelly to axis 98.

While in use, during the rotation of plate 97 about axis 98, the friction occurring between elements 103 and bottles 12*a* housed in seats 99 determines a rotation of each bottle 12*a* about a longitudinal axis A thereof. The combination of the rotation of plate 97 about axis 98 and the rotation of each bottle 12*a* about corresponding axis A increases the efficacy of mixing device 94.

The rotation of plate 97 about axis 98 is controlled so as to stop plate 97 each time with seat 99 of bottle 12*a* to be withdrawn always arranged downwards and at the free portion of surface 96, that is, at the portion of surface 96 not carrying elements 103. In this manner, bottle 12*a* to be withdrawn is always arranged in the same position, that is at the centre of corresponding seat 99 and in contact with corresponding external end-stop element 101, so as to allow a correct withdrawal of bottle 12*a* itself by device 14.

Freshly mixed bottles 12*a* may thus be used in any of the three operation modes previously described.

Finally, it should be noted that at completion of the maintenance operation of machine 1, upper chamber 9 is sterilised by means of a plurality of known UV lamps (not shown) fixed to frame 2.

According to a variant not shown, with machine 1, it is also possible to use plastic material bottles provided with a single neck virtually similar to necks 36 and with an adapter member virtually similar to members 35.

In this case, device 14 withdraws a bag 12*c* from magazine 11 and transfers it to dosage station 13, at which a syringe 12*b* withdraws a determined amount of diluent of bag 12*c* itself.

Device 14 therefore withdraws the above mentioned bottle, transfers it to dosage station 13, at which syringe 12*b* injects the diluent that has been freshly withdrawn from bag 12*c*, and places it on a resting shelf.

Thereafter, device 14 unloads syringe 12*b* in vessel 65, and transfers a new syringe 12*b* from magazine 11 to station 13, at which syringe 12*b* itself withdraws a determined amount of liquid cytostatic compound from bottle 12*a*.

Finally, the freshly withdrawn cytostatic compound is injected in the bottle which has been previously placed on the resting shelf, and the bottle is transferred again to magazine 11 so it may be withdrawn by the operator.

The invention claimed is:

1. A machine for the preparation of pharmaceutical products comprising a magazine for a plurality of containers, each container of at least part of the containers containing a pharmaceutical compound and/a diluent;

a dosage station for the preparation of a pharmaceutical product comprising at least one said pharmaceutical compound and at least one said diluent;

gripping and carrier means to transfer the containers between the magazine and the dosage station; and collection means for the processing waste of the machine, the collection means comprising a vessel and a closing lid for the vessel itself; and wherein the collection means further comprise actuating means to displace the vessel and the lid one with respect to the other in two directions which are transverse to one another.

2. The machine according to claim 1, wherein one of said two directions is vertical.

3. The machine according to claim 1, wherein one of said two directions is horizontal.

4. The machine according to claim 1, wherein the vessel and the lid display corresponding peripheral edges adapted to come into contact with one another following a displacement of the vessel and of the lid in a closure position of the vessel itself; at least one of said edges being provided with a sealing compound.

5. The machine according to claim 1, wherein said collection means further comprise first, and second support means for said vessel and respectively for said lid.

6. The machine according to claim 1, further comprising a chamber for the housing of the magazine, the dosage station, and the gripping and carrier means, a partition wall to separate the chamber and said collection means from one another, and an aperture obtained through the partition wall to connect the chamber and the collection means to one another.

* * * * *